United States Patent [19]

Tavernier

[11] 4,057,457

[45] Nov. 8, 1977

[54] APPARATUS FOR TRANSFERRING LABELS OR LIKE FLEXIBLE SHEETS

[75] Inventor: Georges Antoine Tavernier, Lyon, France

[73] Assignee: Societe Nouvelle Baele Gangloff, Villeurbane, France

[21] Appl. No.: 711,877

[22] Filed: Aug. 5, 1976

[30] Foreign Application Priority Data

Aug. 5, 1975 France ..... 75.25010

[51] Int. Cl.[2] ..... B65C 9/08

[52] U.S. Cl. ..... 156/571

[58] Field of Search ..... 156/568, 569, 570, 571

[56] References Cited

U.S. PATENT DOCUMENTS

| | | | |
|---|---|---|---|
| 3,450,591 | 6/1969 | Zodrow | 156/571 |
| 3,923,589 | 12/1975 | Tavernier | 156/568 |

*Primary Examiner*—Douglas J. Drummond
*Attorney, Agent, or Firm*—Karl F. Ross

[57] ABSTRACT

An apparatus for the transferring of labels or like flexible sheets, e.g. to a transfer drum or the application to bottles or other receptacles, comprises a pickup drum which is formed with a plurality of pickup heads adapted to roll along a stack of labels in a magazine and pick up an individual label for subsequent delivery to the transfer drum. The pickup face is formed as an involute, symmetrical about a median plane perpendicular to its pivot axis and has progressively increasing radius of curvature from a region proximal to the pivot and extending to either side away therefrom.

6 Claims, 2 Drawing Figures

APPARATUS FOR TRANSFERRING LABELS OR LIKE FLEXIBLE SHEETS

FIELD OF THE INVENTION

The present invention relates to an apparatus for transferring labels or like stacked sheets and to the destacking of such sheets as contained in a magazine or the like. More particularly, the invention relates to improvements over the system described in my U.S. Pat. No. 3,923,589.

BACKGROUND OF THE INVENTION

In my aforementioned patent, in which I have described in considerable detail an apparatus for coating labels with adhesive and applying them to objects such as bottles, I have pointed out that pre-existing systems for accomplishing a similar purpose operate with a stack of labels in a magazine adjacent a turntable provided with a plurality of pickup heads.

These heads are orbited about an axis spaced from the label magazine and are each first passed through a coating station at which a layer of adhesive is applied to the outer face of the pickup head. The pickup head is then pressed against the sheet of the stack at the discharge end of the magazine so as to pick up this sheet and transport it to a transfer element which takes the label off the pickup head and applies it to a container.

Prior to my development as described in that patent, there were two principal configurations in which the pickup head was made. In one such arrangement each pickup head had a face with a uniform radius of curvature centered on the rotation axis of the pickup turntable. This arrangement was disadvantageous in that it limited the number of labels which could be carried by the pickup arrangement at any given time since only a number of labels having a collective length equal to the circumference of the pickup device could be accommodated during each revolution of the device. In addition, when the faces of the pickup head were so formed, the turntable had to be rotated at a relatively low speed in order to insure that picked up labels were not dropped.

In any arrangement prior to my development as described in the patent, each pickup head had a radius curvature which was substantially smaller than the overall radius of the pickup device. The labels thus curled around the smaller pickup head to permit a large number of labels to be held on the pickup device at any one time. Even this arrangement had a disadvantage in that curling of the labels around each head was required and, when relatively stiff or inflexible labels were used, the labels could not be held adequately by the pickup device as it rotated. It was necessary further to rotate and drive each of these pickup heads separately, a face which resulted in increased vibration and were particularly disadvantageous when the labels are tightly curled since it further increases their tendency to fall off the pickup head.

Recognizing the disadvantages of such systems, in U.S. Pat. No. 3,923,589, I have described an improved system in which the rotatable turntable carries a plurality of pickup heads, each having a pickup face formed as a curved surface with a radius of curvature which varies over its length. This surface has, at one end, a radius of curvature which is centered on the axis of rotation of the head and has an increasing radius of curvature toward its other end, the pickup head being rotatably mounted at the first mentioned end. Each face had a rectified length (flat length), which was a least as long as the label to be picked up from a stationary magazine adjacent the pickup turntable.

While this device was highly advantageous and constituted a significant improvement over the art, in that it allowed the pickup surface of the head to roll without sliding on the end label of the magazine and was practically without sliding on the surface of the transfer drum, it still did not maximize the number of labels which could be carried by the pickup turntable or drum, especially for labels of considerable length.

The essential characteristic of the improved device which distinguished it from all other known constructions, resided in the configuration of the pickup head with its variable and known constant radius of curvature over the length of the pickup surface. At its smallest radius of curvature, the center of curvature coincided with the pivot axis of the pickup head, i.e. the distance between the axis of the pickup head and the first label of the magazine was equal to the smallest radius of curvature and the pickup surface of each pickup head met the label of the magazine at this smallest distance. The developed length of the pickup surface was at least equal to the length of the label and hence the pickup surface was practically cantilevered over the greater part of its length from the end at which it had the smallest radius of curvature.

To rigorously insure a rolling movement without slippage of the pickup head on the first label of the magazine, the directrix curve of the adhesion surface must correspond to the equation (in polar coordinates):

$$r = \frac{A^2 - R^2}{A \cdot c\left(\frac{\theta\sqrt{A^2 - R^2}}{A}\right) + R}$$

where:

A is the shortest distance between the center of the rotating support and the first label;

R is the radial distance between the center of rotation of the respective pickup head and the center of the turntable or rotatable support carrying same;

$\theta$ is the angle between the radius $r$ and the starting radius, the latter being the smallest radius of curvature as measured to the center of the pivoting head and;

$r$ is the radius between predetermined point on the pickup face and the center of rotation of the respective pickup head carrying this face.

For a full explanation of this relationship see my prior patent identified above.

In the system described in that patent, however, the pickup head has an asymmetric configuration since the pickup surface extends only to one side of the region of minimum radius of curvature. The greatest part of the length of the pickup head corresponds to the portion with larger radius of curvature and thus the greater portion of the length of the label is carried to one side of the center of the pickup head. It is the rolling contact of this cantilevered portion of the pickup head, which must roll along the first label of the magazine which prevents detachment of the label and facilitates the removal thereof from the magazine.

Because of this asymmetrical configuration, the magazine is offset from an axial plane of the pickup drum and considerable stress is applied to the pickup head.

Furthermore, since the greater part of the length of each label must be carried to only one side of each pickup head, the number of labels which can be accommodated on a given turntable and hence the number of pickup heads which can be provided is limited.

OBJECTS OF THE INVENTION

It is the principal object of the present invention to extend the principles set forth in the aforementioned application.

Another object of the invention is to provide an improved apparatus for transferring labels from a stack or magazine thereof.

Still another object of the Invention is to provide an apparatus having a greater capacity and operating speed than my earlier system as set forth in the aforementioned patent.

SUMMARY OF THE INVENTION

I have now found, most surprisingly, that my original system can be improved quite markedly by forming the surface of the pickup head symmetrically with respect to an axial plane therethrough corresponding to the plane of the minimum radius and extending the progressively increasing radius curves symmetrically to either side thereof so that the pickup surface is effectively centered on the pivot axis of the pickup head. In spite of this configuration, the pickup surface rotates without sliding or slippage upon the first label of the magazine and, moreover, labels can be delivered to a transfer drum without slippage or sliding movement. The More specifically, the pickup head is an adhesion surface whose radius of curvature varies to either side from the center of curvature corresponding to the smallest radius of curvature and lying at the pivot axis of the head. The surface of each at this plane of symmetry corresponds to the radius of smallest curvature and increases progressively to a maximum to each side while the total developed length of the adhesion surface remains at least equal to that on the labels to be picked up.

Since the adhesion surface is perfectly symmetrical, the axis of the magazine does not need to be offset from an axial plane of the pickup turntable or support and the axis of the magazine that lie at the point at which the pickup surface of minimum radius of curvature contacts the first label.

The directrix curve defining thus surface is, for the most part, similar to that set forth above and described in my patent except that the curve represents only one half of the surface, the other half being defined by the substitution of $-\theta$ (corresponding negative values of $\theta$) for $\theta$ in this relationship. A truly symmetrical curve is insured because the cosine function is symmetrical for $\theta$ and $-\theta$.

Among the advantages of this system are that the symmetrical configuration makes it possible to accommodate very long labels in relatively little space and without particular stress upon the pickup head which might result from the asymmetrical configuration of the head. It is especially advantageous to design the pickup head so that the ends of the surface distal from the region of smallest radius of curvature approach one another, i.e. are turned back toward the axis of symmetry. This is an especially space-conserving feature and permits a large number of pickup heads to be disposed about the pickup drum.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
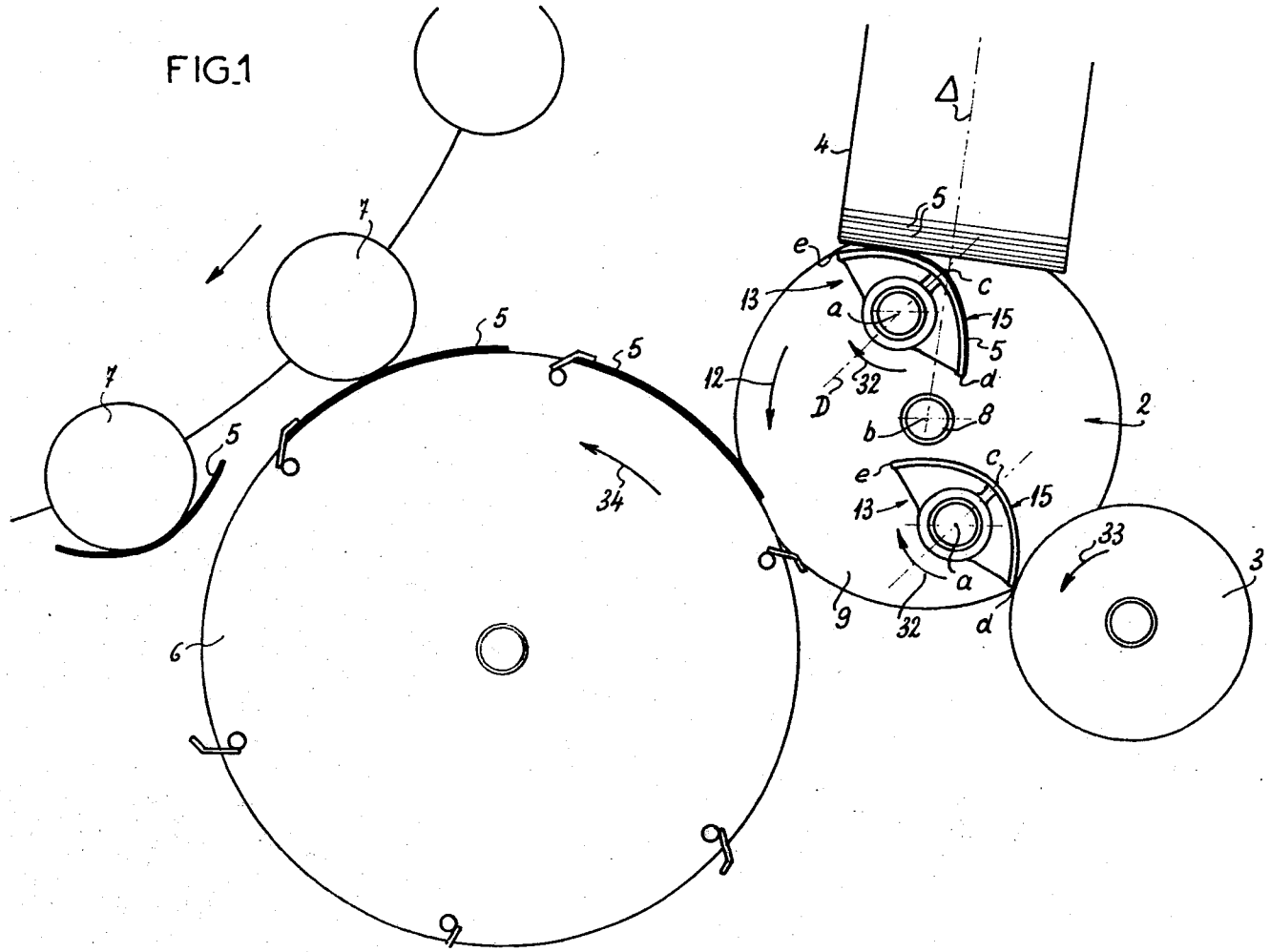
FIG. 1 is a diagrammatic top plan view of an apparatus according to the present invention.

In the following description, reference will be made from time to time to elements which correspond to elements described in my aforementioned patent. These elements, unless otherwise indicated, can be constructed and driven as set forth in this patent, it being noted that the present improvement resides in the particular configuration of the pickup surface.

As described in the aforementioned patent, the apparatus of the present invention comprises essentially a rotatable support or turntable 2 which cooperates with an adhesive-applying or gluing drum or roller 3, a label magazine 4 containing a stack of labels 5, a transfer drum 6 and a turntable carrying a plurality of receptacles 7 to which the labels 5 are to be applied.

The pickup turntable 2 is provided with a vertical shaft 8 on which are disposed a pair of plates, only the lower plate 9 of which is visible, and is provided with means for imparting a constant speed rotation to the turntable in the direction of the arrow 12 about its axis *b*. This support 2 carries, in a specific example serving for purposes of illustration, two pickup heads 13 which are swingable about respective shafts 14 disposed opposite to one another with respect to the axis *b*.

Figure 2:
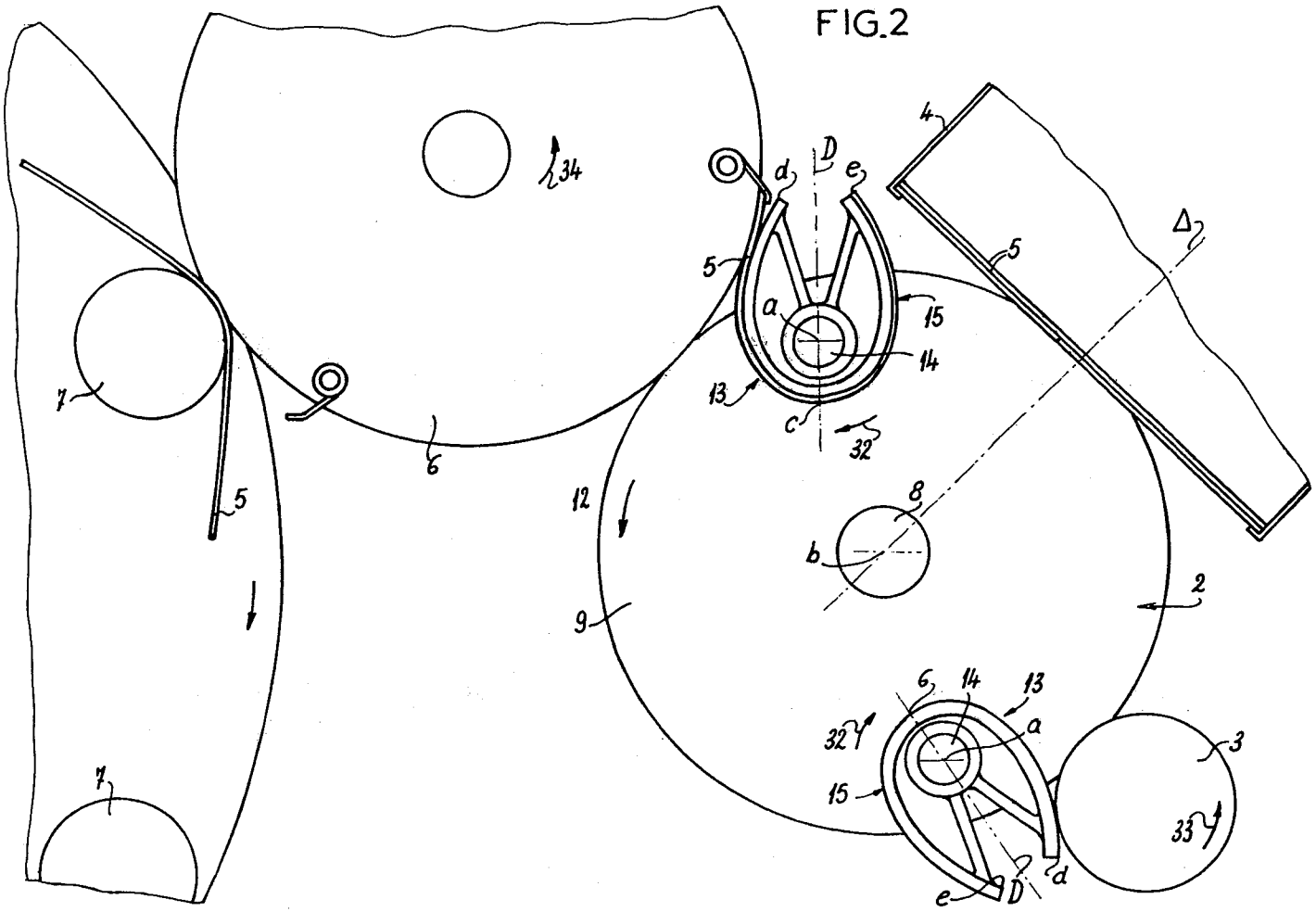
FIG. 2 is a similar view, drawn to somewhat larger scale, of another embodiment of the invention.

Each pickup head 13 has an adhesion surface 15 which is curved with a varying radius of curvature. This pivot axis *a* of each pickup head 13 is also the center of curvature associated with a point *c* on the surface at which the radius of curvature of the surface is the smallest. The minimum radius of curvature is thus equal to the distance separating points *a* and *c*. From the point *c* to either side of a plane of symmetry D, the radius of curvature increases to a maximum value at extremities *d* and *e*. These extremities, as can be seen in FIG. 2 approach the plane of symmetry D after having first receded therefrom.

The adhesion surface is perfectly symmetrical with the plane of symmetry D which passes through the axis *a* and point *c*. Thus the radius of curvature increases from its smallest value at the point *c* to maximum values at points *d* and *e* symmetrically with respect to the plane D. More concretely, the pickup head is symmetrical with respect to a median plane through the pickup surface and therefore can be fabricated particularly easily.

It should be noed that, as described in the aforementioned patent, the developed length of each adhesion surface is equal to the length of the label 5 while the directrix curve of the surface has, in polar coordinates the following equation:

$$r = \frac{A^2 - R^2}{A \cdot \cos\left(\frac{\pm\theta \cdot \sqrt{A^2 - R^2}}{A}\right) + R}$$

where A, R $\theta$ and $r$ have the following meanings:

A is the shortest distance between the center of rotation *b* of the support 2 of the first label 5 of the magazine 4;

R is the straight line distance between the pivot axis *a* and the pivot axis *b* and also corresponds to the radius of the circular trajectory of the axis *a* of the pivot heads 13;

$\theta$ is the angle (positive or negative) between the polar radius considered and the original polar radius (i.e. the radius of point *c*); and

*r* is the length of the polar radius considered.

The symmetrical form of the pickup head 13 permits the median plane Δ of the magazine 4 to coincide with an axial plane of the support 2, i.e. a plane perpendicular to the labels 5 at the centers thereof and through the axis *b*.

In FIG. 1, the extremities *d* and *e* diverge with respect to the median plane D while, in FIG. 2, these extremities converge toward the medial plane. In FIG. 1 $\theta$ has a value less than 90° and the surface and the adhesion surface is relatively short. In the case of FIG. 2 the angle $\theta$ is slightly less than 180° and the ends *d* and *e* approach one another opposite the point *c*.

Each of the pickup heads 13 is driven by means such as that shown in the aforementioned patent and located below the lower plate 9 of the rotatable support 2 so that the heads are operated as represented by arrow 32 when the turntable is driven in the sense represented by arrow 12. The heads are rotated at the speed which varies as a function of the angle position of their pivot axes *a*. As described in the aforementioned patent, this speed variation can be obtained by a differential gear arrangement although it also may be accomplished with a mechanism using a toothed crown operated by an oscillating device.

It should be noted that the pickup heads always rotate in the same sense which is opposite the sense of rotation not only of the support 2 but also of the gluing roller 3 and the transfer drum 6. When the pickup heads 13 approach the gluing roller 3 as shown at the right-hand side of FIG. 1 it initially contacts it at its extremity *d* and the surface 15 rolls practically without slippage upon the gluing roller 3 until the end *e* of the surface loses contact with the gluing roller.

With changing the sense of rotation of the head, the latter engages with its extremity *d* the edge of a pile of labels in the magazine 4 and rolls thereon, thereby picking up the label without slippage and carrying it to the drum 6. At the center of the label, the plane of symmetry D of each head coincides with the median plane Δ of the magazine. As can be seen in FIG. 1 also the movement continues until the end of the particular label is lifted by the extremity *d* of the surface 15. The transfer drum, as described in the aforementioned patent, provided with fingers which engage the label the latter being rolled onto the drum 6 without slippage from the respective surfaces 15. A comparison of FIGS. 1 and 2 will show that the embodiment of FIG. 2 can accommodate a greater number of long labels than is the case when the pickup surface extends to only one side of the pivot axis of the head.

The invention can be modified in different ways, for example for use in the gluing, destacking and transfer of elements other than labels, e.g. foils or sheets.

I claim:

1. In an apparatus for transferring flat flexible sheets which comprises a turntable, means for rotating said turntable about a turntable axis, a stationary magazine holding a stack of sheets adjacent said turntable, at least one pickup head on said turntable about a pickup axis spaced from the said turntable axis and having a curved pickup surface engageable with a sheet of said stack, and means for rotating said head about an axis parallel to the axis of said turntable, the improvement wherein said pickup surface has an axial plane of symmetry extending through the axis of rotation of said head and a smallest radius of curvature at said plane, the radius of curvature of said surface progressively increasing symmetrically to opposite sides of said plane, said surface having a directrix curve which in polar coordinates corresponds to the formula:

$$r = \frac{A^2 - R^2}{A \cdot \cos \frac{(\pm \theta \sqrt{A^2 - R^2})}{(A)} + R}$$

2. The improvement defined in claim 1 where said surface originally diverges from said plane and thereafter approaches said plane toward ends of said surface.

3. The improvement defined in claim 2 wherein said plane intersects said surface at its minimum radius of curvature, said minimum radius of curvature corresponding to the distance between the axis of rotation of said head and said surface.

4. The improvement defined in claim 1 wherein $\theta$ is less than 90°.

5. The improvement defined in claim 1 wherein $\theta$ is greater than 90° but less than 180°.

6. The improvement defined in claim 1 wherein said magazine has a vertical median plane constituting an axial plane of said turntable.

* * * * *